US006021098A

United States Patent [19]

Rebeaud

[11] Patent Number: 6,021,098

[45] Date of Patent: Feb. 1, 2000

[54] DEVICE FOR LIMITING THE ACCELERATION OF AN OSCILLATING WEIGHT DRIVING A MECHANISM OF SMALL VOLUME

[75] Inventor: Jean-Philippe Rebeaud, Cressier, Switzerland

[73] Assignee: Eta Sa Fabriques D'Ebauches, Grenchen, Switzerland

[21] Appl. No.: 09/187,410

[22] Filed: Nov. 6, 1998

[30] Foreign Application Priority Data

Nov. 20, 1997 [CH] Switzerland ..... 2683/97

[51] Int. Cl.[7] ..... G04C 3/00; G04B 1/00; G04B 5/02

[52] U.S. Cl. ..... 368/204; 368/208

[58] Field of Search ..... 368/203–204, 368/206–208

[56] References Cited

U.S. PATENT DOCUMENTS 4,057,885 11/1977 Giger et al. .
4,939,707 7/1990 Nagao .
5,867,454 2/1999 Takahashi et al. ..... 368/148

FOREIGN PATENT DOCUMENTS 0 326 312 8/1989 European Pat. Off. .
1 070 554 12/1959 Germany .
331 275 7/1958 Switzerland .
335 604 2/1959 Switzerland .
371 993 10/1963 Switzerland .
500 521 1/1971 Switzerland .

*Primary Examiner*—Vit Miska
*Attorney, Agent, or Firm*—Sughrue, Mion, Zinn, Macpeak & Seas, PLLC

[57] ABSTRACT

A device for limiting the acceleration which an oscillating weight (1) used to drive or wind a power generator powering an instrument of small volume, can undergo, includes a bearing raceway (2) against which such weight abuts when it undergoes an acceleration substantially exceeding that occurring in normal use of the instrument. For this purpose, the weight (1) is elastically mounted on a moving support member (4) so as to move in the plane of such weight which is then braked by the bearing raceway (2) when the weight undergoes an acceleration which exceeds a certain maximum value.

8 Claims, 2 Drawing Sheets

33
30
11
A2
G1
4
5
G2
A1
B2
31
8
1
B1
10
32

4
11
5
13
7
8
9
6
12
10

DEVICE FOR LIMITING THE ACCELERATION OF AN OSCILLATING WEIGHT DRIVING A MECHANISM OF SMALL VOLUME

The present invention relates to a device for limiting the acceleration of an oscillating weight rotating in a cage and mounted off-centre on a moving support member for driving or winding a mechanism of small volume, particularly of the horological type, and in particular a power generator powering an instrument of small volume.

In particular, the invention concerns such a device arranged in a wristwatch for winding a mechanical movement or for powering an electronic circuit. Likewise, the invention may concern an electronic unit associated with means for receiving and/or transmitting electromagnetic signals.

Limitation devices answering the generic definition given hereinbefore are known, such devices being mounted either in self winding watches or in electronic watches.

As regards self winding watches, Swiss Patent No. A-281 490 may be cited. In this document, the timepiece includes a winding oscillating weight supported by a thin elastic arm, intended to dampen the axial shocks that the weight can undergo. This arm is attached to a pinion meshing wish a toothed sector. The latter carries a pawl co-operating with the barrel ratchet. Two dampening springs limit the oscillations of the weight. The elastic arm is not rectilinear, but extends in a zigzag so as to dampen the radial shocks which the weight undergoes. However, the document does not suggest braking the oscillating weight when the acceleration of the latter exceeds that occurring in normal use of the watch.

For a mechanical watch, Swiss Patent No. A-331 275 can also be cited. In this self winding watch, the oscillating weight has stops fitted therein. The stops have at least one rounded portion which projects with respect to the surface of the weight, so that in the event of violent shocks directed in the direction of the axis of rotation of the weight, the weight does not touch the cage formed by the back cover of the case and the top of the plate. In this construction however, no measures are taken to limit the variation in mechanical power generated by the weight in the event of radial shocks.

It will be observed, in relation to the two aforecited documents, that the anti-shock devices implemented have the primary purpose of preventing the breakeage of the shaft which supports the oscillating weight.

As regards electronic watches, European Patent No. A-0 326 312 can be cited. This document discloses a device for driving a generator supplying electric voltage to a supercapacitor. In order to do this, the device includes an oscillating weight or flywheel mechanically coupled to said generator to drive the rotor thereof. In order to preserve the mechanism from any excess stress on the teeth of the gear train in the event of a shock and thus to avoid breaking such teeth, a friction coupling is provided between the oscillating weight and the generator rotor. In the construction proposed, an intermediate wheel and pinion is inserted between the oscillating weight and the rotor. The weight transmits its movement to a pinion of the intermediate wheel and pinion, this latter including a wheel which is friction fitted onto the shaft of the wheel and pinion, this wheel being meshed with a pinion of the generator rotor. The friction is calculated so that the wheel slips on the shaft when a shock is applied to the weight or, if preferred, when the torque applied to the rotor exceeds an admissible value. Any breakage of the mechanism is thus avoided. It will be noted however, that in mass series manufacturing, it is difficult to assure friction of a constant value and time-consuming fittings are therefore required.

In order to overcome the aforementioned inadequacies or drawbacks, the present invention is characterised in that the cage includes a bearing raceway forming part of the case included in the instrument, this bearing raceway being arranged at a small distance from the path travelled by the oscillating weight and in that the oscillating weight is mounted elastically on said moving support member so as to come into contact with said bearing raceway and to brake said weight when it undergoes an acceleration substantially exceeding that occurring in the normal use of said instrument.

The invention will be explained in more detail hereinafter with reference to the following description of an embodiment and the drawings which illustrate it by way of example and in which.

Figure 1:
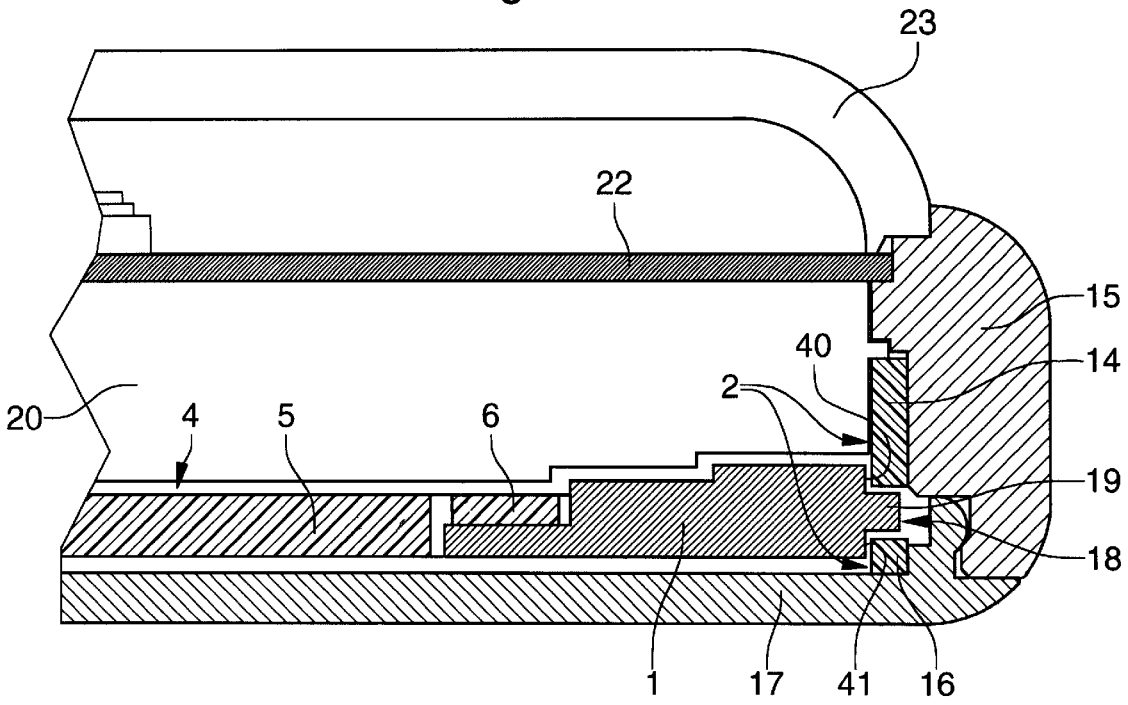
FIG. 1 is a cross-section of a watch case showing a first embodiment of the oscillating weight associated with a bearing raceway.

FIG. 1 shows a watch case including a middle part 15, a snap fitted back cover 17 and a crystal 23. This case encloses a movement 20 on which is mounted a dial 22. It will be noted that an electronic unit used for example for a pager could take the place of movement 20. It will also be noted that this unit could be combined with a watch movement as is described in particular in European Patent No. A-0 569 868.

Figure 2:
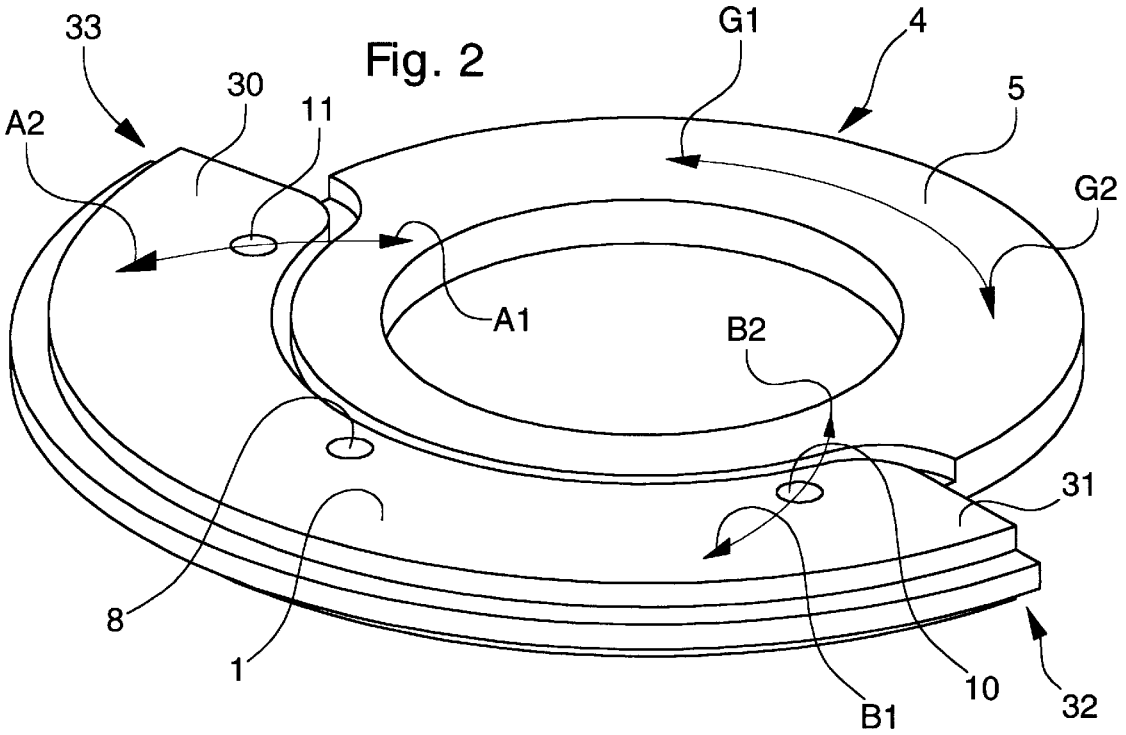
FIG. 2 is a perspective view of the oscillating weight mounted on a moving support member according to the invention.

FIG. 1 shows an oscillating weight 1 rotating in a cage formed by the case, this weight being mounted off-centre on a moving support member 4 (see also FIG. 2). Although not shown in the figures moving support member 4 drives an power generator able to power an instrument of small volume which can be, for example a timepiece or a pager, or a combination of the two, as stated hereinbefore.

The power generator may be a spring mounted in a barrel as is well known from self winding watches. In such case the mechanical coupling existing between the oscillating weight and the barrel can be achieved, for example, as described in Swiss Patent No. A-143 763.

The power generator can be a generator generating an electric voltage as is described for example in European Patent No. B-0 547 083 in which the mechanical coupling between the weight and the generator is explained.

Returning to FIG. 1 and the characteristic feature of the present invention, the cage formed by the case includes a bearing raceway 2, this raceway being arranged at a small distance from the path travelled by oscillating weight 1. Since oscillating weight 1 is elastically mounted on moving support member 4, as will be explained in detail hereinafter, this weight will come into contact with bearing raceway 2 and will be braked by said bearing raceway when it undergoes an acceleration substantially exceeding that occurring in the normal use of the instrument. Thus the variation in mechanical power able to be provided by the oscillating weight is limited to a value above which the mechanism would inevitably be damaged either by breakage of the shaft carrying the weight or by breakage of the teeth of the transmission gear train, as was stated in the preamble of this description.

Figure 3:
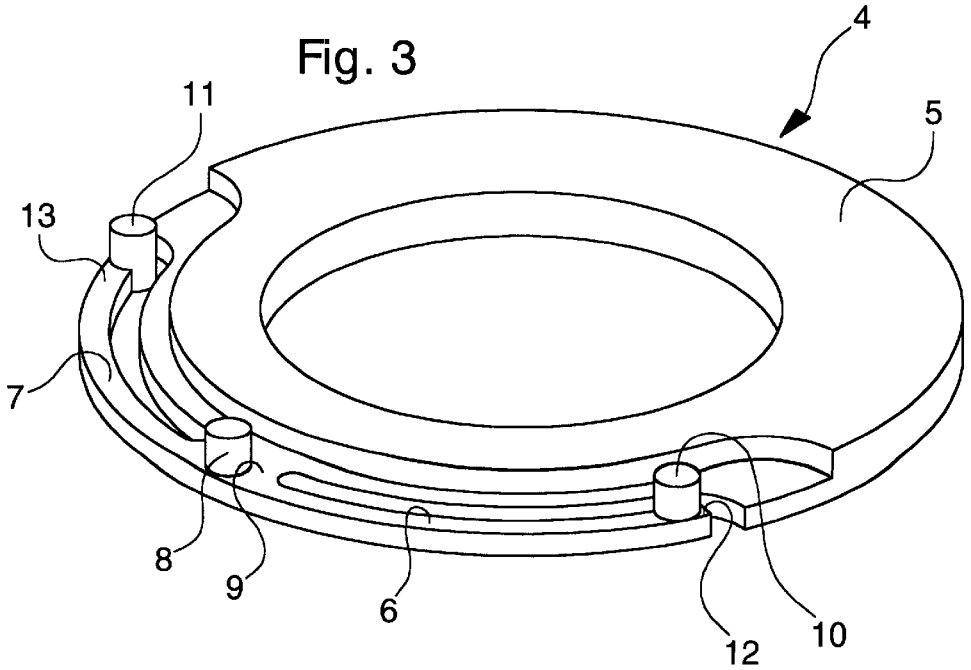
FIG. 3 is a perspective view of the moving support member of FIG. 1 without the oscillating weight.

One way, amongst others, of elastically mounting oscillating weight 1 on moving support member 4 is shown in FIGS. 2 and 3. Here, moving support member 4 is a ring 5 at the periphery of which are arranged or cut two opposite arms 6 and 7. A stud 8 is arranged at the beginning of arms 6 and 7, weight 1 being able to pivot about said stud. Moreover, weight 1 is held in place by studs 10 and 11, stud 10 being arranged at the end 12 of arm 6 and stud 11 being arranged at the end 13 of arm 7. Finally, in support ring 5 a wheel 5 (not shown) is arranged which meshes in a known manner with the mechanism driving the power generator, whether it is a spring winding a barrel or a generator generating an electric voltage.

Oscillating weight 1 is made of a heavy material, for example cast iron support ring 5 can be made of plastic material, as can arms 6 and 7 which are fixed thereto. Studs 8, 10 and 11 can be integral with ring 5. If they are made of plastic material, it will be understood that once weight 1 is placed on ring 5, it is sufficient to heat the end of studs 10 and 11 to rivet weight 1 onto ring 5.

In the event of radial shocks exerted in the direction of the plane of the instrument case, these shocks cause oscillating weight 1 to generate a mechanical power substantially exceeding that provided in the normal use of the instrument, weight 1 pivots about stud 8 (FIG. 2). At this moment, if the movement of ring 5 occurs in the direction of arrow G1, end 30 of weight 1 moves towards the centre of ring 5 along the direction of arrow A1 and end 31 of weight 1 moves away from the centre of ring 5 along the direction of arrow B1. As the path travelled by the periphery of oscillating weight 1 is at a small distance from support bearing 2 (see FIGS. 1 and 4), forming part of the case, zone 32 of end 31 of weight 1 comes into contact with bearing raceway 2 and brakes weight 1. Likewise, if the movement of ring 5 occurs in the direction of arrow G2, end 31 of weight 1 moves towards the centre of the ring along the direction of arrow B2, as end 30 moves away therefrom along the direction of arrow A2 and it is zone 33 of end 30 of weight 1 which comes into contact with bearing raceway 2 to brake the weight.

The manner of elastically mounting weight 1 on support ring 5 is not limited to the embodiment shown in FIGS. 2 and 3. One could, for example, only have pivoting stud 8, on ring 5, and arms 6 and 7 could each be replaced by a spring anchored in the ring and resting in the radial direction on end 30 or 31 respectively of weight 1. Whichever construction is selected, the elastic constant of the arm or spring will be selected so that braking of the weight occurs as soon as the acceleration to which the oscillating weight is subjected exceeds that occurring in normal use, thus exceeds a certain limit. A weight acceleration of 500 g as a limit value is willingly cited.

So far one has been concerned with tangential braking, i.e. that which is exerted on the weight tangentially to the lateral peripheral edge thereof, in the event of radial shocks. This braking prevents in particular, breakage of the teeth of the wheel (not shown) mounted on support ring 5 when such wheel drives an electric generator. In order for this generator to generate sufficient voltage across its terminals, it is necessary to have available between the wheel and the generator a gear ratio of approximately 100. In the event of a shock, the generator rotor can be considered locked, as is the intermediate wheel and pinion inserted between said generator and said fly wheel (see aforecited European Patent No. A-0 326 312). Thus, the stress in the teeth of one of the wheel and pinions of the kinematic chain becomes very high because of the added inertia of the generator rotor and these teeth break if nothing is provided to limit the variation in power generated by the the weight.

In order to make tangential and lateral braking possible, the path travelled by the weight is situated at a small distance from the support raceway forming part of the cage of the instrument, the weight mounted elastically on the support ring coming into contact with the bearing ring during significant shocks.

The bearing raceway forming part of the cage of the instrument can be executed in different ways. A first way is shown in FIG. 1. Here, bearing raceway 2 includes a first bearing ring 14 forming part of middle part 15 of case 5 and a second ring 16 forming part of back cover 17 of the same case. It will be noted that a space 18 is arranged between the two rings, a space in which a projection 19 battlement-shaped arranged on the outer edge of weight 1 can rotate. On either side of projection 19, weight 1 has respectively a first arc-shaped zone 40 capable of coming into contact with first bearing ring 14 and a second arc-shaped zone 41 capable of coming into contact with second bearing ring 16 in order to assure the claimed braking effect. Battlement-shaped projection 19 inserted between the two rings has the purpose of limiting the shake which the weight could take during axial shocks, i.e. directed in the direction of the shaft about which the weight rotates, these shocks being able to lead to breakage of the shaft carrying the weight if this limitation did not exist.

FIG. 1 shows again that first ring 14 can also be used as casing ring for movement 20.

Figure 4:
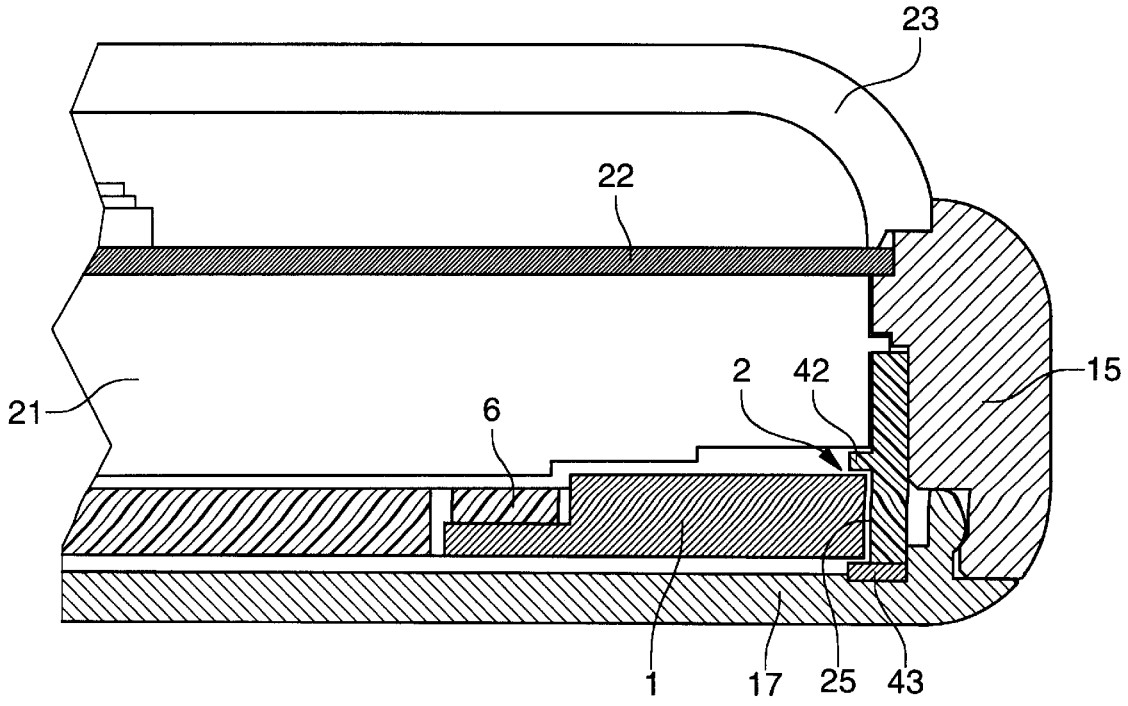
FIG. 4 is a cross-section of the watch case showing a second embodiment of the oscillating weight associated with a bearing raceway.

A second way of achieving bearing raceway 2 is shown in FIG. 4. Here the portion defining this bearing raceway has the shape of a stirrup 25 within which weight 1 can oscillate. In this construction weight 1 has no peripheral projection and the outer edge thereof is straight. During radial shocks, this edge comes into contact with the bottom of stirrup 25 which defines said bearing raceway to brake the weight. The purpose of wings 42 and 43 of stirrup 25 is to limit the shake which weight 1 could take during axial shocks, as explained hereinbefore. It will be noted that in order to facilitate the mounting of the weight in the stirrup, wing 43 can be added onto the stirrup afterwards or form part of back cover 17 of the case.

What is claimed is:

1. A device for limiting the acceleration of an oscillating weight rotating in a cage and mounted off-centre on a moving support member to drive or wind an power generator powering an instrument of small volume, wherein the cage includes a bearing raceway attached to the case included in the instrument, said bearing raceway is arranged at a small distance from the path travelled by the oscillating weight, and wherein said oscillating weight is elastically mounted on said moving support member so as to come into contact with said bearing raceway and to brake said weight when it undergoes an acceleration substantially exceeding that occurring in normal use of said instrument.

2. A device according to claim 1, wherein said power generator is a spring mounted in a barrel.

3. A device according to claim 1, wherein said power generator is a generator generating an electric voltage.

4. A device according to claim 1, wherein said moving support member is a ring and wherein the elastic mounting of said oscillating weight on said ring is achieved by means of two opposite arms cut out of the ring, said weight is on the one hand capable of pivoting about a stud arranged at the beginning of the arms and on the other hand held in place by a stud arranged at the end of each of the arms.

5. A device according to claim 4, wherein the support ring is made of plastic material and wherein the oscillating weight is made of a heavy material.

6. A device according to claim 1, wherein the bearing raceway is defined by a first bearing ring forming part of a middle part of the case and by a second ring forming part of a back cover of the same case, a space being arranged between the two rings, and wherein the outer edge of said weight includes a battlement-shaped projection arranged in said space.

7. A device according to claim 6, wherein the first ring is used as casing ring for a movement of the instrument.

8. A device according to claim 1, wherein the bearing raceway is defined by the bottom of a stirrup within which the peripheral portion of said weight can oscillate.

* * * * *